United States Patent [19]

Conrad

[11] 4,413,660

[45] Nov. 8, 1983

[54] APPARATUS FOR TWIST-TYING CEILING HANGERS FROM JOISTS

[76] Inventor: James R. Conrad, 1631 Grandview, Glendale, Calif. 91201

[21] Appl. No.: 304,245

[22] Filed: Sep. 21, 1981

[51] Int. Cl.[3] ..... B21F 15/04

[52] U.S. Cl. ..... 140/119; 140/104; 140/124

[58] Field of Search ..... 140/104, 115, 117, 118, 140/119, 122, 124, 149, 53, 54, 57, 123

[56] References Cited

U.S. PATENT DOCUMENTS 2,857,792 10/1958 McNish ..... 140/123

3,030,984 4/1962 Vogt et al. ..... 140/119

*Primary Examiner*—Lowell A. Larson

*Assistant Examiner*—Linda McLaughlin

*Attorney, Agent, or Firm*—Wagner & Bachand

[57] ABSTRACT

Apparatus for the rapid twist-tying of a wire ceiling hanger onto a ceiling joist, comprising easily bendable wire of U-shape with a relatively longer leg and a relatively shorter leg having their respective axes in a common plane and radially spaced for straddling the joist, the apparatus comprising an axially rotatable handle slidably engaging the joist-straddling wire hanger by the longer of its legs and radially inward of the hanger shorter leg, and pivotally mounted on the handle a fork adapted to capture the shorter hanger leg for helical movement around and toward the hanger longer leg responsive to simultaneous rotation and axial displacement of the handle relative to the joist, whereby the captured shorter leg is wrapped around the hanger longer leg freely of the handle.

18 Claims, 6 Drawing Figures

28
38
26
12
36
34
30
32
72
24
46
74
70
44
10
42
40
14
16
18
20
22
3
48
58
64
68
62
66

APPARATUS FOR TWIST-TYING CEILING HANGERS FROM JOISTS

TECHNICAL FIELD

This invention has to do with apparatus useful in the building trades, and more particularly is concerned with apparatus facilitating and highly automating the installation of ceiling wire hangers on joists, from a floor location.

BACKGROUND ART

In the construction of certain types of buildings horizontal beams in the form of oppositely facing angles are erected far above the floor, and the ceiling is hung from these beams at some distance down. The ceiling typically is of the metal grid and removable acoustical tile type. The support for the grids is often a wire hanger which is twist-tied onto the overhead beam at one end and connected to the grid below at the other, lower end. Installation of the necessary wire hangers is labor intensive at this time. An installer, on a ladder or scaffold moves along the beam feeding the wire hangers around the beam, and individually twisting one leg of a U-shape bent into the wire around the other longer leg. Multiple twists free of unduly sharp bends are necessary.

The accomplishing of this repetitive task by hand is costly, but until the present invention, no better means has been known or adopted.

DESCRIPTION OF THE INVENTION

It is therefore an object of the present invention to provide apparatus for the mechanical twist-tying of wire hangers onto joists. It is another object to enable such apparatus to be operated from floor level. It is another object to use power tools to accomplish the twisting. Still another object is the ready, remote application of pre-bent wire hangers to the joist, and the rapid twist-tying of them by simple operation of a hand drill rotated handle, accompanied by the simultaneous downard displacement of the handle supporting the wire at the joist. A further object is to provide a novel configuration of wire forming tool which is response to rotation by a handle winds one leg of a wire hanger about the other in joist mounting relation in a uniformly reproducible helical pattern of desired tightness or looseness. Another object is the provision of a wire bend guide.

These and other objects of the invention to become apparent hereinafter are realized in accordance with the invention in apparatus for the rapid twist-tying of a wire ceiling hanger onto a ceiling joist, the wire hanger comprising easily bendable wire of U-shape with a relatively longer leg and a relatively shorter leg having their respective axes in a common plane and radially spaced for straddling the joist, the apparatus comprising an axially rotatable handle slidably engaging the joist-straddling wire hanger by the longer of its legs and radially inward of the hanger shorter leg, and pivotally mounted on the the handle a fork adapted to capture the shorter hanger leg for helical movement around and toward the hanger longer leg responsive to simultaneous rotation and axial displacement of the handle relative to the joist, whereby the captured shorter leg is wrapped around the hanger longer leg freely of the handle.

In particular embodiments of the invention, an electric motor is coupled to the handle for rotatably driving the same in wire twisting relation; the handle comprises a pole extendible to the ceiling joist and a hanger longer leg support block carried by the pole, the block defining a locus of axial support for the hanger longer leg proximate the joist, and means urging the hanger longer leg into frictional engagement with the block for support; the block has an axial bore defining the locus of hanger longer leg support, and a transverse slot for bodily passing the hanger longer leg through the block to the locus, the slot and bore being relatively arranged to block reverse passage of the hanger longer leg through the slot and leg dislodgement from the locus under handle rotation; the handle defines a locus of engagement with the hanger longer leg, the fork comprises a pair of arms converging to a common junction radially spaced from the locus of engagement a distance corresponding to the distance between the respective axes of the hanger legs, and a fork tang secured to the handle in fork arm supporting relation; the fork tang carries the fork arm junction in an orbital plane about the locus of longer leg engagement with the handle responsive to handle rotation in shorter leg engaged relation of the junction; the fork arms respectively lie at different angles relative to the oribital plane, whereby the captured hanger shorter leg differentially engages the arms in fork tipping relation toward the handle responsive to engagement of the hanger shorter leg and the fork arms; the radially outer of the fork arms is relatively elongated and shaped to capture and guide the hanger shorter legs toward the junction; the radially inner of the fork arms has a relatively short extent cooperating with the outer fork arm to define the junction, and a continued extent defining the fork tang, the continued extent being chordally journaled in the handle, and means blocking other than pivoting movement of the outer fork arm continued extent in the handle responsive to the simultaneous rotation and displacement of the handle relative to the joist; the blocking means engages the arm continued extent on opposite sides of the handle, and is adapted simultaneously to engage the hanger longer leg.

In a preferred embodiment, the fork arms are formed from rigid wire bent upon itself, the rigid wire having a first portion defining the radially outer of the fork arms and in a plane angled relative to the oribital plane, a second portion defining the relatively inner of the fork arms and in the orbital plane, a third portion defining the junction between the arms, a fourth portion generally at a right angle to the first and second portions, and a fifth portion alined with respect to the inner arm portion to carry the fork at a suitable disposition for capturing the hanger shorter leg e.g. generally parallel to, preferably within 20° and coplanar with the inner arm-defining portion forming the handle journaled continued extent of the inner arm-defining second portion, the rigid wire portions being relatively proportioned to locate the junction-defining portion beyond the minimum radial distance between the handle and the inner arm-defining portion; the inner arm continued extent extends chordally through the handle and from both sides thereof, and the blocking means comprises wire wrapped around the exposed portions of the continued extent adjacent the handle, the wire having a terminal portion engageable with the hanger longer leg in slidable relation to frictionally support the wire hanger in the handle proximate the joist; the handle comprises a tubular pole extendible to the ceiling joist, a leg support block is provided comprising a rigid plug at the upper end of the pole, the plug having an axial bore defining a locus of hanger longer leg support and a transverse slot for bodily passing the hanger longer leg through the plug to the bore, the slot being nonradially disposed to define with the wall of the bore a detent shoulder against radial dislodgement of the hanger leg from the bore in wire terminal portion engaged relation under handle rotation while permitting relative axial longitudinal and rotational movement of the pole and the hanger longer leg; the rigid plug defines a transverse bore beyond the axial bore, the transverse bore being adapted to journal the inner arm continued extent for pivoting movement of the arm responsive to rotational and axial displacement of the pole; and at the end of the pole opposite the rigid plug, means are provided adapted to drive the pole rotatably about its longitudinal axis, e.g a portable power drill coupled to the pole in rotatably driving relation.

In a modified form the invention comtemplates a relatively elongated fork tang carrying guide means having a cusped base extending radially from the handle, the base defining a series of recesses adopted to receive the hanger shorter leg in one or another recess in leg coparallel orientation determining relation.

In a highly particular embodiment, the invention contemplates apparatus for the rapid, twist-tying of a wire ceiling hanger onto a joist, the wire hanger comprising easily bendable wire in a U-shape with legs of uneven length and adapted to straddle the joist with the respective axes of the legs in a common vertical plane; the apparatus comprisng a tubular handle pole, a metal plug at the upper end of the pole, a power drill coupling at the opposite end of the pole, a longitudinal slot in the pole adapted to bodily pass the longer of the preformed wire hanger legs parallel to the pole, the plug having an axial bore adapted to receive the hanger longer leg coaxially with the pole and a transverse bore nonradially formed in the plug for passage of the hanger longer leg from the pole slot in registration therewith to the plug axial bore, wire means maintaining the hanger longer leg in a desired axial relation with the plug, the wire means comprising first and second portions and a terminal portion; fork means radially outboard of the pole for angularly deflecting the shorter of the hanger legs onto and around the longer thereof, the fork means including a tang journaled in the plug transverse bore and a pair of non-coplanar fork arms integrally formed with the tang, the radially outer of which arm extends downward and outward from the radially inner of the arms, the wire means first and second portions being wound about the tang at chordally opposed locations on the pole to fix the tang against other than rotational movement, the wire means terminal portion slidably maintaining the hanger longer leg in predetermined axial adjustment in the plug axial bore, the fork arms converging to a common point spaced from the pole a distance to engage the hanger shorter leg, whereby the fork means on pole rotation engages the hanger shorter leg and on further rotation and downward displacement of the pole pivots on its tang and tips itself as a result of the relative orientation of the inner and outer arms and the hanger shorter leg with it toward the pole-carried longer leg and helically wraps the length of the hanger shorter leg about the hanger longer leg just below the joist.

THE DRAWINGS

The invention will be further described as to an illustrative embodiment in conjunction with the attached drawings in which.

PREFERRED MODES

Figures 1, 2:
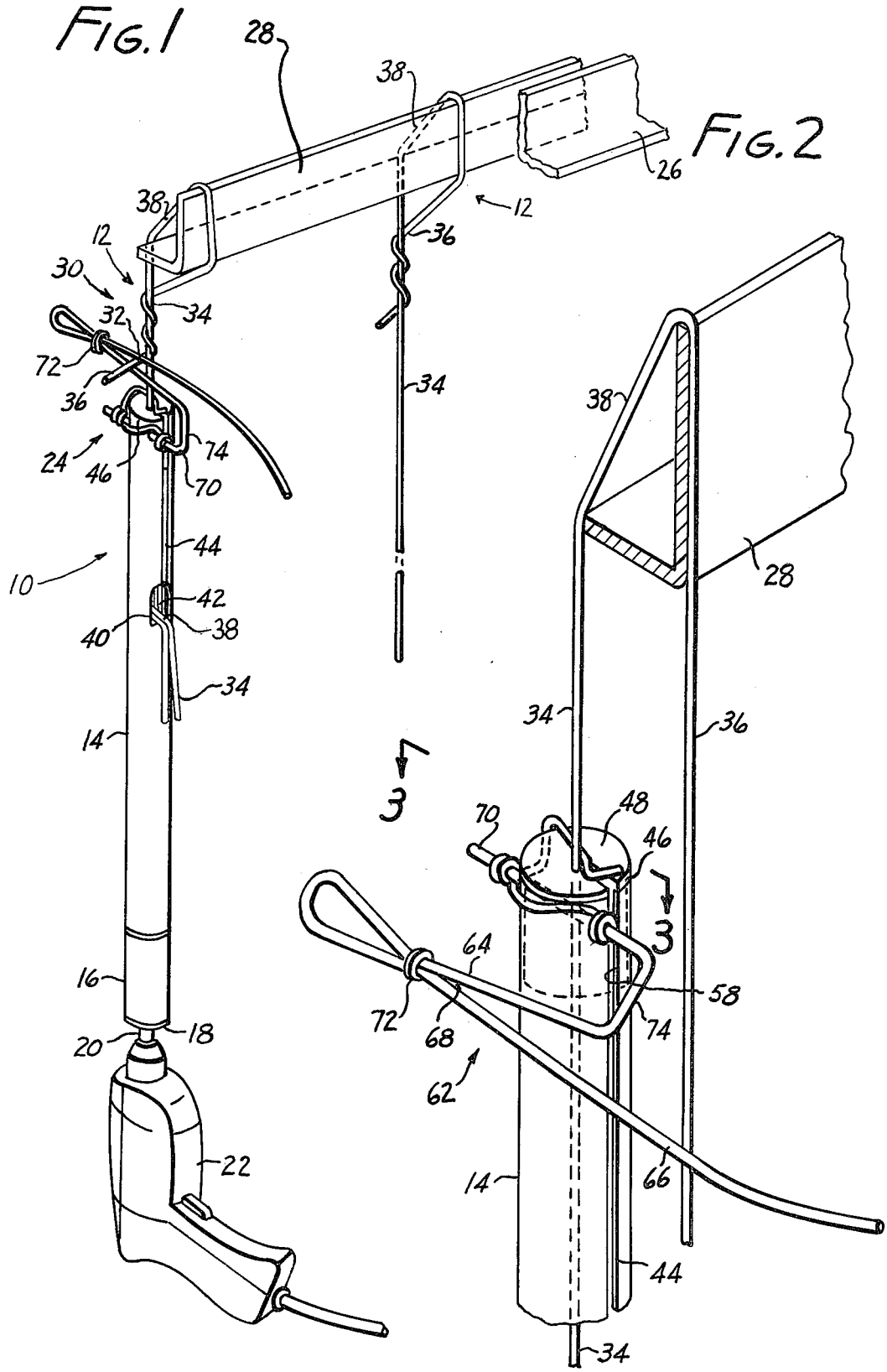
FIG. 1 is a perspective view of the present apparatus twisting a hanger wire, and adjacent a previously twist-tied hanger wire; and, FIGS. 2 through 5 are perspective detail views of the twist-tie apparatus shown in progressive positions through the twist-tie operation.

With reference now to the drawings in detail, in FIG. 1 the twist-tying apparatus is shown at 10 and the ceiling hanger wire at 12. The twist-tying apparatus comprises an axially rotatable handle 14 having a lower end portion 16 providing a coupling 18 for engaging the bit 20 of power drill 22. An operator positions the handle 14 with its upper portion 24 immediately adjacent the joist 26, 28, and with the wire hanger in position as hereinafter described, operates the drill motor, causing rotation of handle 14, and twisting of the wire about the joist by virtue of capture of the wire 12 by fork 30. The operator pulls the handle 14 downwardly, simultaneously with rotation, so that the locus of wire hanger 12 engagement on the fork 30 describes a helix, smaller end down.

Turning now to FIGS. 2–5, ceiling joist 26 is typically an angle oppositely paired e.g. with joist 28 and suspended by conventional means not shown to form a ceiling support. Such joists 26, 28 are generally far higher from the floor than the room ceiling is intended to be and thus false ceilings are used, hanging from the joists. Installation of these ceilings is a problem since wire hangers 12 must be hung periodically along the joist 26, and the installer must climb to the joist, twist the wire per code, descend, climb again, and so on until the requisite number of ceiling hanger wires is in place.

The present invention permits this task to be performed remotely, from the floor, by power means, and without need of climbing ladders of scaffolding.

The basic apparatus, operation, and result is depicted in FIG. 1. In FIGS. 2–5 the details of the hanger wire twisting are shown, and the twist-tying movement of the fork illustrated.

As shown in FIG. 2, the twist-tying operation begins with a pre-bent, generally U-shaped wire 12, having a longer leg 34 and a shorter leg 36. The bight 38 of the wire hanger 12 is sized to easily overfit the width of joist 28 so that the hanger straddles the joist. Typically, numerous of the hangers 12 are thus pre-bent before commencing an installation. The wire of hangers 12 is easily bent to a desired shape. The pre-bent hanger 12 U's are conveniently stored within the handle 14 by dropping the longer leg 34 thereunto and permitting the bight 38 to rest on lower edge 40 of handle opening 42. See FIG. 1. A longitudinal slot 44 in handle 14 permits the hanger 12 to be drawn upwardly by its bight 38 to be snapped into twisting position. This is shown in FIG. 2, where the bight 38 of the hanger 12 has been drawn upward, past the handle end 46 and rigid end plug 48 therein, shorter leg 36 is first laid over joist 28, and lowered until bight 38 contacts the joist 28. Control of the relative position of the hanger 12 and the handle 14 is by detent means **56*a*** hereinafter described.

The hanger longer leg 34 is now coaxial with the handle 14 and lies in an axial bore 52 defined by plug 48. The hanger 12 is kept slidably supported in this position by a relatively heavier wire 54 terminal portion 56 which is bent to have detent 56*a* resiliently urging the hanger longer leg 34 into plug axial bore 52. It will be noted that plug 48 has a transverse, longitudinal slot 58 non-radially aligned, and registered with longitudinal slot 44 in handle 14. The plug slot 58 enables the hanger bight 38, pulled to the end 46 of the handle 14 to be positioned for straddling onto joist 28 by pressing longer leg 34 sideways through slot 58 past detent 56*a*. The nonradial, offset positioning of plug slot 58 relative to plug bore 52, forms a detent shoulder 60, best seen in FIG. 5, which with the cooperation of wire detent 56*a* maintains the hanger leg 34 journaled in the axial bore 52 during handle 14 rotation.

With the handle 14 poised as shown in FIG. 2, and the hanger 12 straddling the joist 28 also as shown, the twist operation can commence. Twisting is effected by fork 62 capturing the wire hanger shorter leg 36 and carrying it helically about the hanger longer leg 34 as the longer leg is pulled progressively from the plug bore 52 by drawing the handle 14 progressively downward from the joist 28 as the drill 22 (FIG. 1) is operated.

Figure 6:
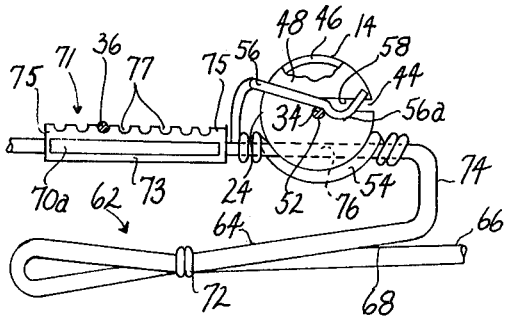
FIG. 6 is a view like FIG. 3, showing a modified form of the invention.

In general, the fork 62 which accomplishes the twisting comprises a pair of arms: radially inner arm 64, radially outer arm 66, which converge to a common junction 68. The junction 68 is radially spaced from the hanger longer leg 34 which has its locus of journaling engagement in the axial bore 52 of the plug 48, a distance such that upon orbiting or circular movement the junction will engage the hanger shorter leg 36, i.e., a distance corresponding to the distance between the respective vertical axes of the hanger legs 34, 36, more or less, since the sweeping shape of arm 66 will ensnare a outwardly splayed shorter leg 36 and guide it to the junction 68, and similarly, the arm 64 will guide an inwardly splayed shorter leg 36 to the same junction. Precise alignment of the legs 34, 36 can be obtained by the use of the gauge shown in FIG. 6. There, fork tang 70*a* is extended well beyond the handle portion 24. A guide 71 comprising a cusped base 73 and opposed ears 75 is journaled on tang 70*a*. After wire hanger leg 34 is inserted in plug bore 52, the shorter leg 36 is bent in or out as necessary to align the leg 36 with one or another intercusp recess 77 selected to give the desired coparallel orientation of legs 34, 36 and for straddling the particular joist at the job site.

The fork arms 64, 66 are supported, cantilever fashion by fork tang 70. Before turning to a description of the mode of operation of the fork 62, its structure will be more particularly described. With reference again to FIGS. 2–5, it will be seen that the fork 62 and its tang 70 are portions of the same heavy gauge spring wire, rigid enough to repetitively twist the much lighter guage wire hanger leg 36. The fork 62 wire is bent upon itself, a first portion thereof defining the radially outer of the fork arms, arm 66, in a plane angled upwardly from the circular, orbital plane the fork 62 describes when carried circularly by rotation of handle 14.

Figure 3:
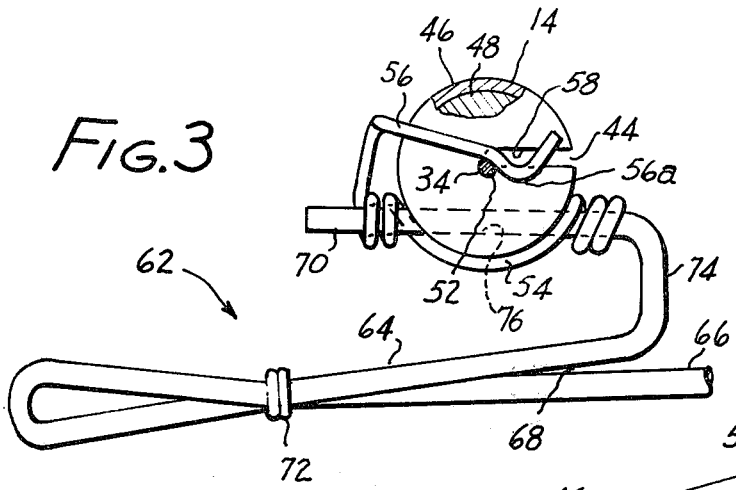
Figure 4:
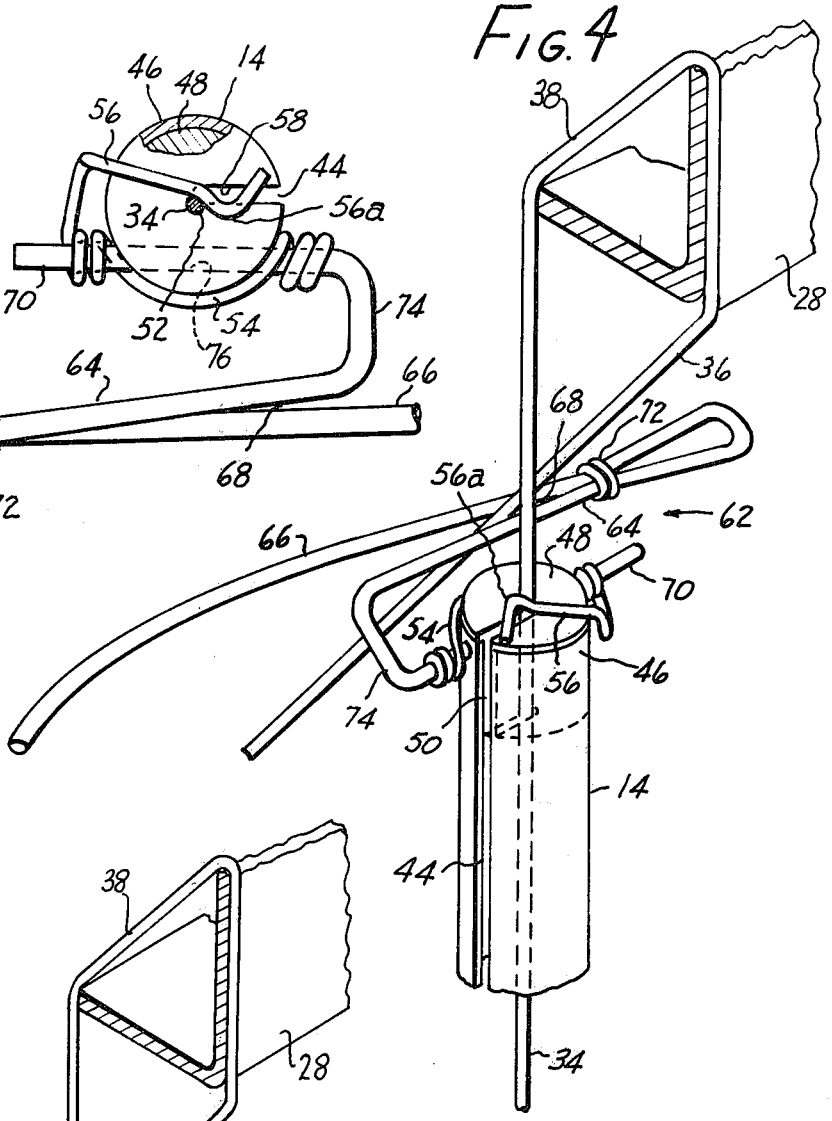
Figure 5:
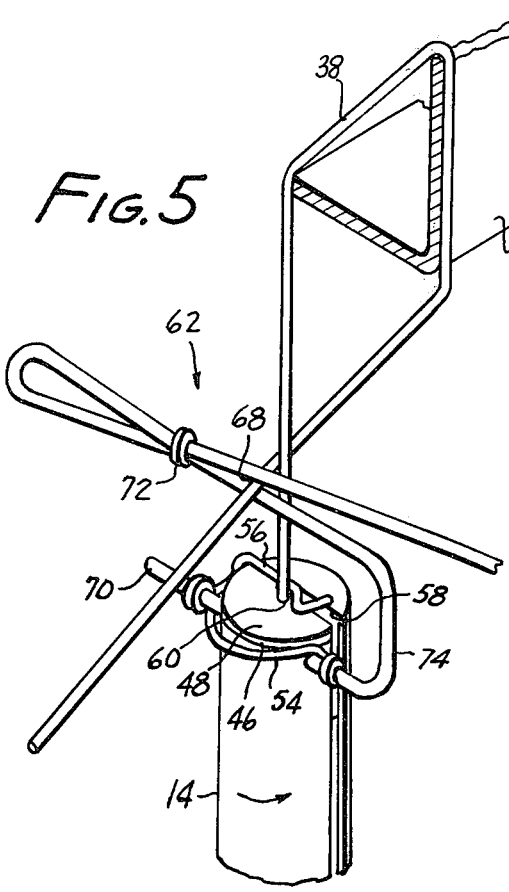

A second portion of the fork 62 wire is bent to define the relatively inner of the fork arms, arm 64, which lies in the fork 62 orbital plane, unlike arm 66, see FIGS. 2 and 3. The fork 62 wire continues beyond arms 64, 66 to a third portion between the first and second portions, which defines junction 68. The actual wire bend in fork 62 is made beyond the junction 68, as shown in FIGS. 2–5, with the arms 64, 66 held together at junction 68 by wire turns 72. The arms 64, 66 can also be welded together to form the junction 68. The fork 62 wire has a fourth portion 74, generally at a right angle to the first and second portions, arms 64, 66; (i.e. within 20° of parallel) and a fifth portion, forming tang 70, generally parallel to and coplanar with the inner arm 64 defining portion, as a continued extent of the inner arm. The tang 70-forming wire portion is journaled in transverse chordal bore 76 through plug 48, to enable pivoting movement of the fork 62 angularly of the axial plane of hanger longer leg 34. Medium gauge spring wire 54 is wrapped about the tang 70 on either side of the handle 14 to maintain the bore-journaled condition to the tang 70. It will be recalled that wire 54 terminal portion 56 defines detent 56*a* for hanger leg 34 sliding engagement. The force at detent 56*a* is sufficient to support the hanger 12 in position relative to the handle 14 for placing the bight 38 of the hanger over joist 28, but not so tight as to block simultaneous rotation of the handle relative to the hanger longer leg 34, and axial sliding as well as the handle 14 is drawn downwardly during handle rotation under drill 22 operation, freeing hanger leg 34 from detent 56*a*.

The nature of the joist is not critical, nor is the construction of the handle beyond the plug portion described in detail. Poles having adjustable length are highly desirable as the handle 14. Materials of construction are generally steel spring wire and metal plugs, and steel or aluminum tubing for the handle.

There is thus provided in accordance with the invention, apparatus for the mechanical twist-tying of wire hangers onto joists, operable from floor level, employing power tools to accomplish the twisting for the ready, remote application of pre-bent wire hangers to the joist, and the rapid twist-tying of them by a rotated handle, accompanied by the simultaneous downward displacement of the handle supporting the wire at the joist, including a novel configuration of wire forming tool which in response to rotation by a handle winds one leg of a wire hanger about the other in joist mounting relation in a uniformly reproducible helical desired pattern.

I claim:

1. Apparatus for the rapid twist-tying of a wire ceiling hanger onto a ceiling joist, said wire hanger comprising easily bendable wire of U-shape with a relatively longer leg and a relatively shorter leg having their respective axis in a common plane and radially spaced for straddling said joist, said apparatus comprising an axially rotatable handle slidably engaging said joist-straddling wire hanger by the longer of its legs and radially inward of said hanger shorter leg, and a fork pivotally mounted on the handle having a tang and a pair of non-coplanar arms the radially outer of said arms extending downward and outward from the radially inner of said arms whereby said fork is adapted to differentially engage and capture said shorter hanger leg for helical movement around and toward said hanger longer leg responsive to simultaneous rotation and axial displacement of said handle relative to said joist whereby said hanger shorter leg is wrapped around said hanger longer leg freely of said handle.

2. Apparatus according to claim 1, including also an electric motor coupled to said handle for rotatably driving the same in wire twisting relation.

3. Apparatus according to claim 1, in which said handle comprises a pole extendible to said ceiling joist, a hanger longer leg support block carried by said pole, said block defining a locus of axial support for said hanger longer leg proximate said joist, and means urging said hanger longer leg into frictional engagement with said block for support.

4. Apparatus according to claim 3, in which said block has an axial bore defining said locus of hanger longer leg support, and a transverse slot for bodily passing said hanger longer leg through said block to said locus, said slot and bore being relatively arranged to block reverse passage of said hanger longer leg through said slot and leg dislodgement from said locus under handle rotation.

5. Apparatus according to claim 1, in which said handle defines a locus of engagement with said hanger longer leg, said fork arms converging to a common junction radially spaced from said locus of engagement a distance corresponding to the distance between the respective axes of said hanger legs.

6. Apparatus according to claim 5, in which said fork arm junction is carried in an orbital plane about the locus of longer leg engagement with said handle responsive to handle rotation in shorter leg engaged relation of said junction.

7. Apparatus for the rapid twist-tying of a wire ceiling hanger onto a ceiling joist, said wire hanger comprising easily bendable wire of U-shape with a relatively longer leg and a relatively shorter leg having their respective axes in a common plane and radially spaced for straddling said joist, said apparatus comprising an axially rotatable handle slidably engaging said joist-straddling wire hanger by the longer of its legs and radially inward of said hanger shorter leg, said handle defining a locus of engagement with said hanger longer leg; a fork pivotally mounted on said handle, said fork comprising a pair of arms adapted to capture said shorter leg and converging to a common junction radially spaced from said locus of engagement a distance corresponding to the distance between the respective axes of said hanger legs, and a fork tang secured to said handle in fork arm supporting relation for carrying said fork arm junction and said shorter leg captured therein in an orbital plane about the locus of longer leg engagement with said handle responsive to handle rotation, said fork arms lying at different angles relative to said orbital plane, whereby said captured hanger shorter leg differentially engages said arms in fork tipping relation toward said handle responsive to engagement of said hanger shorter leg and said fork arms, and said hanger shorter leg is wrapped around said hanger longer leg freely of said handle.

8. Apparatus according to claim 7, in which the radially outer of said fork arms is relatively elongated and shaped to capture and guide said hanger shorter legs toward said junction.

9. Apparatus according to claim 8, in which the radially inner of said fork arms has a relatively short extent cooperating with said outer fork arm to define said junction, and a continued extent defining said fork tang, said continued extent being chordally journaled in said handle, and means blocking other than pivoting movement of said outer fork arm continued extent in said handle responsive to said simultaneous rotation and displacement of said handle relative to said joist.

10. Apparatus according to claim 9, in which said blocking means engages said arm continued extent on opposite sides of said handle, and is adapted simultaneously to engage said hanger longer leg.

11. Apparatus according to claim 9, in which said fork arms are formed from rigid wire bent upon itself, said rigid wire having a first portion defining the radially outer of said fork arms and in a plane angled relative to said orbital plane, a second portion defining the relatively inner of said fork arms and in said orbital plane, a third portion defining said junction between said arms, a fourth portion generally at a right angle to said first and second portions, and a fifth portion generally parallel to and coplanar with said inner arm-defining portion forming said handle journaled continued extent of said inner arm-defining second portion, said rigid wire portions being relatively proportioned to locate said junction-defining portion beyond the minimum radial distance between said handle and said inner arm-defining portion.

12. Apparatus according to claim 11, in which said inner arm continued extent extends from both sides of said handle in chordal relation, and in which said blocking means comprises wire wrapped around the exposed portions of said continued extent adjacent said handle, said wire having a terminal portion engageable with said hanger longer leg in slidable relation to frictionally support said wire hanger proximate said joist.

13. Apparatus according to claim 11, in which said handle comprises a tubular pole extendible to said ceiling joist, a leg support block comprising a rigid plug at the upper end of said pole, said plug having an axial bore defining a locus of hanger longer leg support and a transverse slot for bodily passing said hanger longer leg through said plug to said bore, said slot being non-radially disposed to define with the wall of said bore a detent shoulder against radial dislodgement of said hanger leg from said bore in wire terminal portion engaged relation under handle rotation while permitting relative axial longitudinal and rotational movement of said pole and said hanger longer leg.

14. Apparatus according to claim 13, in which said rigid plug defines a transverse bore beyond said axial bore, said bore being adapted to journal said inner arm continued extent for pivoting movement of said arm responsive to rotational and axial displacement of said pole.

15. Apparatus according to claim 14, including also at the end of said pole opposite said rigid plug, means adapted to drive said pole rotatably about its longitudinal axis.

16. Apparatus according to claim 15, including also a portable power drill coupled to said pole in rotatably driving relation.

17. Apparatus according to claim 9, including also a fork tang carried guide means having a cusped base extending radially from said handle, said base defining a series of recesses adopted to receive said hanger shorter leg in one or another recess in leg coparallel orientation determining relation.

18. Apparatus for the rapid, twist-tying of a wire ceiling hanger onto a joist, said wire hanger comprising easily bendable wire in a U-shape with legs of uneven length and adapted to straddle said joist with the respective axes of said legs in a common vertical plane; said apparatus comprising a tubular handle pole, a metal plug at the upper end of said pole, a power drill coupling at the opposite end of said pole, a longitudinal slot in said pole adapted to bodily pass the longer of said preformed wire hanger legs parallel to said pole, said plug having an axial bore adapted to receive said hanger longer leg coaxially with said pole and a transverse bore nonradially formed in said plug for passage of said hanger longer leg from said pole slot in registration therewith to said plug axial bore, wire means maintaining said hanger longer leg in a desired axial relation with said plug, said wire means comprising first and second portions and a terminal portion; fork means radially outboard of said pole for angularly deflecting the shorter of the hanger legs onto and around the longer thereof, said fork means including a tang journaled in said plug transverse bore and a pair of noncoplanar fork arms integrally formed with said tang, the radially outer of which arms extends downward and outward from the radially inner of said arms, said wire means first and second portions being wound about said tang at chordally opposed locations on said pole to fix said tang against other than rotational movement, said wire means terminal portion slidably maintaining said hanger longer leg in predetermined axial adjustment in said plug axial bore, said fork arms converging to a common point spaced from said pole a distance to engage the hanger shorter leg, whereby said fork means on pole rotation engages the hanger shorter leg and on further rotation and downward displacement of said pole pivots on its tang and tips itself as a result of the relative orientation of said inner and outer arms and the hanger shorter leg with it toward said pole-carried longer leg and helically wraps the length of said hanger shorter leg about the hanger longer leg just below the joist.

* * * * *